United States Patent [19]

Nakajima

[11] Patent Number: 4,685,419

[45] Date of Patent: Aug. 11, 1987

[54] METHOD AND APPARATUS FOR POWDER SURFACE TREATING

[75] Inventor: Takashi Nakajima, Hyogo, Japan

[73] Assignee: Nippon Paint, Company, Ltd., Osaka, Japan

[21] Appl. No.: 775,886

[22] Filed: Sep. 13, 1985

[30] Foreign Application Priority Data

Sep. 14, 1984 [JP] Japan ..... 59-193514

[51] Int. Cl.[4] ..... B05C 19/02

[52] U.S. Cl. ..... 118/620; 118/600; 118/DIG. 5

[58] Field of Search ..... 118/620, DIG. 5, 600

[56] References Cited

U.S. PATENT DOCUMENTS 3,916,826 11/1975 Knudsen ..... 118/DIG. 5

4,008,685 2/1977 Pierce ..... 118/DIG. 5

4,011,832 3/1977 Westervelt ..... 118/DIG. 5

4,073,265 2/1978 Walling et al. ..... 118/DIG. 5

*Primary Examiner*—Shrive P. Beck

*Attorney, Agent, or Firm*—Austin R. Miller

[57] ABSTRACT

A method and apparatus for powder surface treatment by turning the powder into a fluidized layer while passing gas made, at least partially, of a reactive gas, through the powder, to improve dispersion stability of powder pigments.

Since the powder is turned into the fluidized layer by gas made, at least partially, of reactive gas, powder particles are put in close and uniform contact with the reactive gas, ensuring full surface treatment of the powder.

6 Claims, 5 Drawing Figures

METHOD AND APPARATUS FOR POWDER SURFACE TREATING

BACKGROUND OF THE INVENTION

This invention relates to methods and apparatus for surface treatment of powdered materials for easier dispersion of the powdered material in fluids.

When powder is dispersed in fluids, especially in liquids, for example when pigment is dispersed in resin varnish, where the fluid is generally referred to herein as the "carrier" or "vehicle", low affinity of the powder for the fluid adversely affects dispersion of the powder throughout the fluid. It is therefore necessary to improve affinity of the powder for the fluid by surface treatment of the powder.

Dry surface treatment of powder has a number of advantages, such as being a simple process. As an example, see the method of treating surfaces of organic pigments with low temperature plasma and of dispersing pigments in resin having polar groups and/or a polar solvent as disclosed in Japanese Patent Application No. 58-217559, laid open to the public.

For surface treatment of powder using the low-temperature plasma method to be fully successful, however, improvements in the apparatus and in the productivity of the process are problems to be solved—these require getting both satisfactory contact efficiency and uniformity between the plasma and the powder being treated.

OBJECTS OF THE INVENTION

It is a general object of the present invention to provide methods and apparatus for surface treatment of powder which brings the powder into uniform and effective contact with a reactive gaseous phase

SUMMARY OF THE INVENTION

This invention provides methods and apparatus for treating the surface of a powder, such as a pigment, to provide better dispersion of the powder within a fluid, especially a liquid, by treating the powder as a fluidized layer by blowing a gas, which is at least partly a reactive gas, through the powder layer.

DETAILED DESCRIPTION OF THE INVENTION

Figure 1:
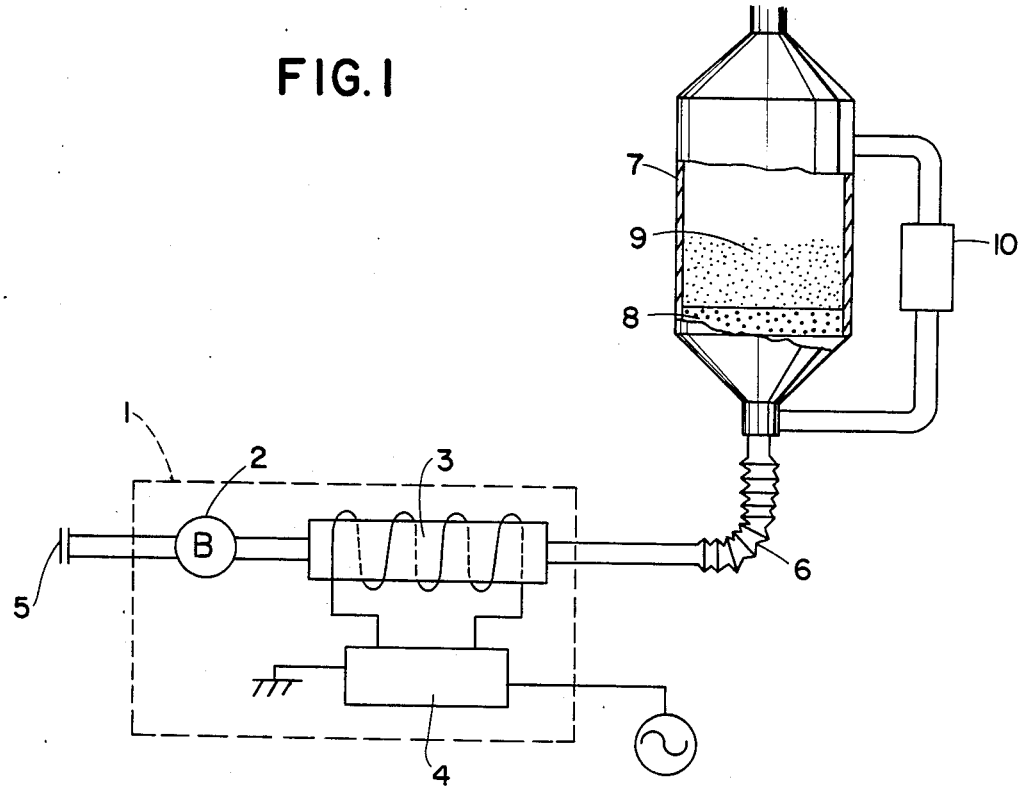
FIG. 1 is a drawing of apparatus manifesting aspects of the invention.

The present invention provides a method of powder surface treatment by maintaining the powder as a fluidized layer by gas which is at least partly a reactive gas. As used herein, a "reactive gas" means a gas containing a reactive agent. A "reactive agent" is one which reacts with the powder surface to produce at least one and preferably multiple types of polar groups thereon.

Gases, such as air, containing oxygen and gases without oxygen may be activated by, for example, being in proximity with a high frequency electrical surface discharge. From gas, such as air, containing oxygen, ozone, $O^-$ and $O_2^-$ are produced as reactive agents upon such activation by electrical discharge. From gas without oxygen, such as nitrogen gas for example, $N^-$ and $N_2^-$ are produced as reactive agents upon such activation by electrical discharge.

The invention also provides apparatus, for powder surface treatment as a fluidized bed, having a porous plate with holes smaller than the powder particles and having means to generate reactive gas and to supply gas, made at least partly of the reactive gas, into said fluidized bed through said porous plate.

The reactive gas may be produced, for example, by apparatus developed by recent progress in ceramic technology and in ultra high-frequency electrical oscillation technology. For an example of suitable apparatus see "Ceramic-made Electrode Panels For Generating Ion and Ozone" by Masuda et al. in *Proceedings of the Institute of Electrostatics*, 1983, page 22, column 12.

An example of high frequency surface discharge for gas activation is the ozone generating method of the high-frequency surface discharge type by ceramic electro-static apparatus. The method and apparatus for activating the gas by high frequency surface discharge are not limited in their particulars. Such methods and apparatus have high efficiency in generating reactive gas and are advantageous in their costs.

In the invention, the gas, preferably at least partly including oxygen gas ($O_2$), such as air, is activated by such apparatus as mentioned above. Then the gas, preferably at least partly including ozone gas (hereafter called "ozone" for short) is generated. The reactive gas may be mixed with an appropriate gas, according to the kind of powder to be treated.

For powder surface treatment, a gas, made at least partly of reactive gas, is blown up from the bottom of the powder to keep the powder in a floating suspended condition to define the fluidized layer. This puts the powder in close and uniform contact with the gas, insuring uniform treatment of the surface of each solid powder particle. Heat exchange is carried out better than with known methods of powder treatment, with no possibility of local overheating: temperature control is also easier. The whole fluidized layer may be vibrated during surface treatment of the powder to increase fluidity and to realize uniform powder-gas contact more effectively. To do this, the plate supporting the fluidized bed may be vibrated, or gas pressure may be varied discontinuously, for example When reactive gas is used for surface treatment of powder as described above, the powder surface is oxidized by reactive gas and is activated. Organic powder (organic pigment for example) is oxidized by the reactive gas and polar groups, such as carboxyl groups, carbonyl groups, hydroxyl groups, and nitro groups, are produced from nonpolar compounds, activating the powder surface. Since the powder surface retains many functional groups in this manner, in addition to paint applications, this invention may be used for pre-treatment of powders for use in other surface processes such as in coating, changes in quality by chemical reaction or physical adsorption of other substances.

On the surface of an inorganic powder, polar groups are produced from non-polar compounds in the same manner as for an organic powder if the inorganic powder surface is coated with an organic substance. Most pigments of the inorganic series are coated with organic substances or the like on their surfaces, and at the surface of the coated layer polar groups are produced in the same manner as with organic powder.

Affinity of powder, which has been provided with polar groups in this manner, for fluid having polar groups is improved and such powder is dispersed in the fluid in a favorable condition. As the fluid with polar groups resins or solvents with polar groups may be used, for example. Suitable resins with polar groups include, for example, polyester, alkyd, vinyl, acrylic, urethane, epoxy, polyamide, melamine, and urea resins.

Examples of suitable polar solvents are methanol, butanol and other alcoholic solvents, ethyl acetate, butyl acetate and other solvents of the ester series, methyl-ethyl ketone (MEK), methyl isobutyl ketone (MIBK) and other solvents of the ketone series, 2-nitropropane, methylene chloride. dimethylformamide and water.

These resins and solvents may be used independently or two or more kinds may be mixed.

Resins without any polar group such as polystyrene, polybutadiene and polyethylene and solvents without any polar group such as benzene, toluene, xylene and other mixed solvents of the hydrocarbon series may also be used.

The powders treated by the surface treating method and apparatus of the present invention are not limited in their particulars. All kinds of powders which can be activated for improved dispersion stability or improved dissolution by producing polar groups such as carboxyl groups on the powder surface, or all kinds of powders subjected to pretreatment for other surface treatments, as described above, can be used. For example, organic pigments (such as quinacridone pigment, phthalocyanine blue, phthalocyanine green and other crude pigments), inorganic pigments having surfaces coated with organic substances (for example, processed pigments such as titanium oxide, carbon black, or iron oxide coated with a surface active agent), lake pigment, pigment processed by surface adsorption of a surface treating agent, high-molecular powder resin (such as polyethylene, polypropylene, polystyrene, or nylon beads), and fatty powders (such as powders of animal or plant fats, oils like creaming powder, cocoa and other food and drink powders) may be treated. Treating time depends on the kind of powder treated and reactive gas concentration and perhaps other conditions. Among powders which may be treated by the method or the apparatus of the present invention are pigments for paint dispersed and suspended in a fluid (sometimes referred to herein as the "vehicle") by the ordinary pigment dispersing method.

When organic and synthetic pigments intended for paint are subjected to surface treatment to increase stability of dispersion into varnish to make paint, a paste made of the surface treated powder dispersed into the varnish for the paint shows better fluidity and viscosity than paste made of non-treated powder. Pigment dispersion is better. When paint film is formed with paste made of treated powder, optical characteristics of the paint film surface (specular gloss and image distinctness gloss, for example), color strength, color evenness and mechanical properties of the paint film are very much improved over those of paint film surfaces formed with pastes made of non-treated powder.

When the organic synthetic pigment for paint is of the quinacridone type, carboxyl groups and/or carbonyl groups are produced on the powder surface by the surface treatment method and apparatus to increase dispersion stability into the varnish of the paint pigment performance of the paint film is improved.

The blown gas for the powder surface treatment is preferably air or an incombustible gas moving at a rate of about 1–5 m/minute passing speed through the powder. When gas containing oxygen ($O_2$), such as air, is used, it may contain preferably 0.1 to 2.0 mole % ozone, measured by the ordinary ozone measuring method (cf. C. M. Birdsall et al. Anal. Chem. 24 662 (1952), E. D. Boelter et al. Anal. Chem. 22 1533 (1950)). The powder density of the fluidized layer may preferably be 0.5 to 20.0 g/cm$^2$.

If the passing speed of gas directed through the powder is slower than about 1 m/min., uniform powder surface treatment may not result. If the speed is over 5 m/min., on the other hand, the powder may be blown away. An appropriate passing speed is based on specific gravity and particle size of the powder. If the ozone content of the gas is less than 0.1 mol %, when measured by the above referred measuring method, uniform surface treatment may not result, and if the ozone content is over 2.0 mol %, the powder may be denatured. Powder density in the fluidized layer lower than 0.5 g/cm$^2$ may lower the process efficiency due to a lesser quantity of powder being treated at a time. If the powder density in the fluidized layer is over 20 g/cm$^2$ on the other hand, the powder surface may not be treated uniformly.

There is no need to prepare another gas for blowing through the powder if air is filtered, dried, passed through reactive gas generator to obtain air containing reactive gas and is then used for treating the powder in a fluidized layer by the method described above.

When the concentration of reactive gas in the gas blowing through the powder is too low, oxygen-rich air or another oxygen-rich incombustible gas may be passed through a reactive gas generator to get more reactive gas: the resulting reactive gas can then be used for treating powder in a fluidized layer by the method described above.

In some cases, heating or firing of the powder may occur depending on oxygen concentration in the gas used for powder blowing. In such case, it is advisable to lower oxygen concentration by adding nitrogen gas ($N_2$), carbon dioxide gas ($CO_2$) or another incombustible gas to the powder blowing gas.

Figure 5:
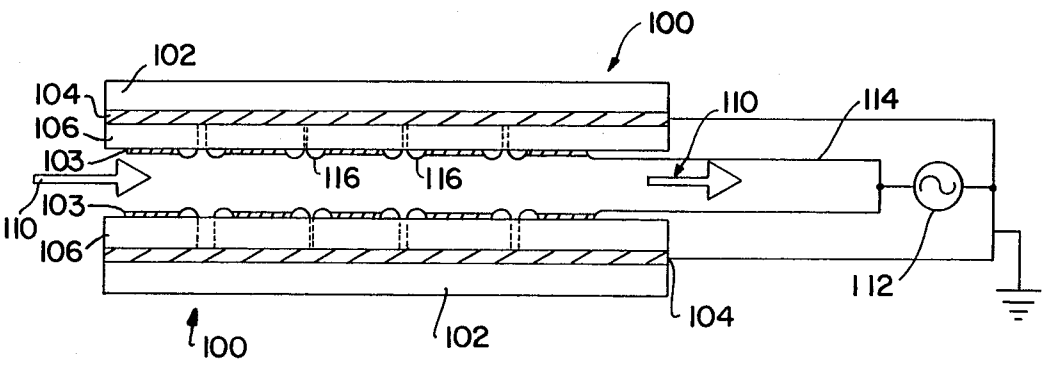
FIG. 5 is a schematic side elevation of two ceramic plate assemblies which may be used in practicing the invention.

Within the reactive gas generating tube there are preferably at least two ceramic surface discharge plate assemblies having two kinds of electrodes, one electrode 108 provides surface discharge while the other electrode 104 is a ground electrode. Two such ceramic plate assemblies are illustrated schematically in FIG. 5 in which each one of the two ceramic plate assemblies is designated generally 100. Each ceramic plate assembly 100 is fabricated generally as a laminate and includes an insulating lamina 102, a ground electrode 104, a ceramic plate 106 and a multi-branched electrode 108, with the insulating lamina 102, the ground electrode 104, the ceramic plate 106 and the multi-branched electrode 108 being sandwiched together, as shown in FIG. 5, in the form of lamina. Two such ceramic plate assemblies 100 are placed in facing disposition, as illustrated in FIG. 5, with the multi-branched electrodes of each of the two plates in reasonably close proximity to one another. Flow of gas is provided as indicated by arrow 110 in FIG. 5 with the gas flowing between the two ceramic plate assemblies 100 oriented with their multi-branched electrodes 108 facing one another. Further provided is means 112 for generating a high-frequency high voltage electrical signal in the manner that a first polarity of the signal is provided by a line 114 to the respective multi-branched electrode 108 of the ceramic plate assemblies 100 and a second polarity of the signal is provided to ground and the ground electrodes 104 of the respective ceramic plate assemblies 100, in the manner indicated schematically in FIG. 5.

When the high frequency high voltage signal is applied to the ceramic plate assemblies 100 in the manner indicated in FIG. 5, surface discharge arcs indicated generally as 116 are produced at the edges of multi-branched electrodes 108. These arcs result from the capacitive effect of the ceramic plate 106 as the high-frequency high voltage signal applied to multi-branched electrode 108 endeavors to reach ground potential, as represented by ground electrode 104. When the air or gas molecules pass close by surface discharge arcs 116 as indicated by gas flow arrow 110, the surface discharge arcs activate the gas molecules and thereby form a reactive gas for introduction into the fluidized bed.

It is to be understood that a number of ceramic plate assemblies 100, disposed in pairs as illustrated in FIG. 5, may be used to practice the method of the invention and in apparatus embodying the invention.

To check the effect of the present invention as set forth in the following examples, apparatus as shown in FIG. 1 was used for powder surface treatment. The reactive gas generator 1 is provided with a blower 2, a reactive gas generating tube 3, and a high-frequency oscillator 4. Dry air drawn through an inlet 5 is activated by tube 3 to contain reactive gas and then is sent to a fluidized bed reactor 7 through a flexible connection tube 6. The fluidized bed reactor 7 has a porous plate 8 at its bottom. A fluidized layer of powder, such as a pigment, 9 is formed on the porous plate 8 by said air containing the reactive gas passing therethrough, and then the surface treatment is carried out. Since the fluidized bed reactor 7 is provided with a vibrator 10, the fluidized layer 9 of powder is vibrated by vibrator 10 to promote uniform surface treatment of the powder.

In the first example, as the powder a pigment of quinacridone type (Cinquacia red Y-RT759D available from DuPont) was used. Conditions of the surface treatment were as stated below. As the reactive gas generator, a Micro Ozonizer (OC-05 module made by Elstat Corporation) was used.

Air flow in reactive gas generator . . . 1.5 l/min.
Quantity of produced ozone ($O_3$)
by the measuring method specified above . . . 0.30 to 0.50 g/hr.
Ozone concentration (at 20° C.) by the measuring method specified above . . . 0.17 to 0.28 mol %
Treated quantity of quinacridone pigment . . . 6.0 g/batch
Porous plate . . . Glass filter of 30 mm diameter (5 to 10 μm mesh)
Air speed passing through porous plate . . . 2.1 m/min.
Powder density of fluidized layer . . . 0.85 g/cm The treating time was changed for each batch of powder as shown in Table 1 for surface treatment of each powder batch under the above-stated conditions. Zero treating time is for comparison and the other times are examples of powder treatment.

After treatment, each batch of powder was mixed with an amphoteric alkyd resin of the short-oil type made from palm oil (specifically alkyd varnish R5532 of 54% non-volatile content and about 2000 molecular weight, made by Nippon Paint Company, Osaka, Japan) in such a manner that the weight ratio of the pigment (P) to the carrier or vehicle (R) is kept at P/R=0.88. Then, toluene was added to obtain a paste, which resulted after dispersion for 6 hours with a paint shaker.

The paste formed of dispersed surface treated powder showed more and, indeed, outstanding Newtonian flow characteristics compared with the paste formed of dispersed non-treated powder.

Each of the pastes obtained in the manner stated above was applied to a glass plate using a doctor blade to film thickness of 125 μm. Then 20° specular gloss and 60° specular gloss were checked according to Japanese Standards Institute JIS Z-8741. The results are shown in Table 1.

Viscosity of each paste (at 20° C.) was checked with an E-type viscometer (made by Tokyo Keiki of Tokyo, Japan) and the results are also shown in Table 1. The yield values by Casson's equation are shown in the table as well.

Casson's equation is:

$$\tau_\theta^{0.5}=\tau_o^{0.5}+\eta_\infty^{0.5}\cdot\gamma^{0.5}$$

Where, $\tau_\theta$: Shearing stress [dyne/cm$^2$]

$\tau_o$: Yield value [dyne/cm$^2$]

$\eta_\infty$: Viscosity at infinite shearing rate (Residual viscosity) [dyne-sec/cm$^2$]

$\gamma$: Shearing rate [1/sec.]

Zero yield value ($\tau_0=0$) means Newtonian flow, which indicates that the fluid is ideal.

TABLE 1

| Treating time [min] | 0 | 15 | 30 | 60 | 90 |
|---|---|---|---|---|---|
| 60° specular gloss [%] | 23.7 | 28.2 | 47.9 | 59.3 | 72.7 |
| 20° specular gloss [%] | 0.7 | 1.0 | 5.6 | 11.7 | 27.1 |
| 5 rpm viscosity [poise] | 20.9 | 18.0 | 0.70 | 0.54 | 0.54 |
| 50 rpm viscosity [poise] | — | 1.62 | 0.55 | 0.48 | 0.47 |
| Yield value [dyne/cm$^2$] | 359 | 134 | 0.5 | 0.07 | 0.08 |

As shown in Table 1, the pastes made of powder (specifically a pigment) which is subjected to surface treatment with gas which is at least partly reactive gas and then dispersed into varnish show smaller viscosity and better fluidity than the paste made of non-treated powder. This is due to presence of carboxyl groups and so forth produced on the surface of the powder. The lower viscosity and better fluidity of pastes made of treated powder are also indicated by smaller yield values (minimum shearing stress required to cause the fluid to flow, that is to say, nearly equal to Newtonian flow). When paint film is formed with each paste, pastes with surface treated powder show better gloss and better dispersion of powder than paints formed of pastes having non-treated powder. As shown in the table, surface treatment of 30 minutes or more is preferable.

A second example embodying the invention is shown below: A quinacridone pigment (Cinquacia red Y made by DuPont) was subjected to surface treatment, in the same manner as set forth above for the first example, under the following conditions of treatment. The same reactive gas generator used for the preceding example was used.

Air flow in reactive gas generator . . . 3.0l/min. (=50 cm$^3$/sec)
Quantity of produced ozone by the measuring method specified above . . . 0.30 to 0.50 g/hr.

Concentration of ozone by the measuring method specified above . . . (at 20° C.) . . . 0.10 mol %

Quantity of treated pigment . . . 10 g/batch

Porous plate . . . Funnel type glass filter of 65 mm diameter

An speed passing through porous plate . . . 2.1 m/minute

Powder density of fluidized layer . . . 0.30 g/cm$^2$

Treating time . . . 60 minutes

Each of the surface treated pigments, which were subjected to the surface activating treatment method of the invention, and non-treated pigment, all of which were of the same compounding as shown below, was dispersed into a paste using a sand grinder, and then measured as described below at regular intervals after starting dispersion.

| Dispersion compounding | |
|---|---|
| Varnish (Alkyd varnish R-5532 of 54% non-volatile content and about 2000 molecular weight made by Nippon Paint Company containing amphoteric alkyd resin of the short oil type made from palm oil) | 250 g |
| Solvent (Solvesso 100 naphtha by Exxon Chemical Japan) | 150 g |
| Pigment | 100 g |
| Total of the above | 500 g |
| Medium: Glass beads | 600 g |

Figure 3:
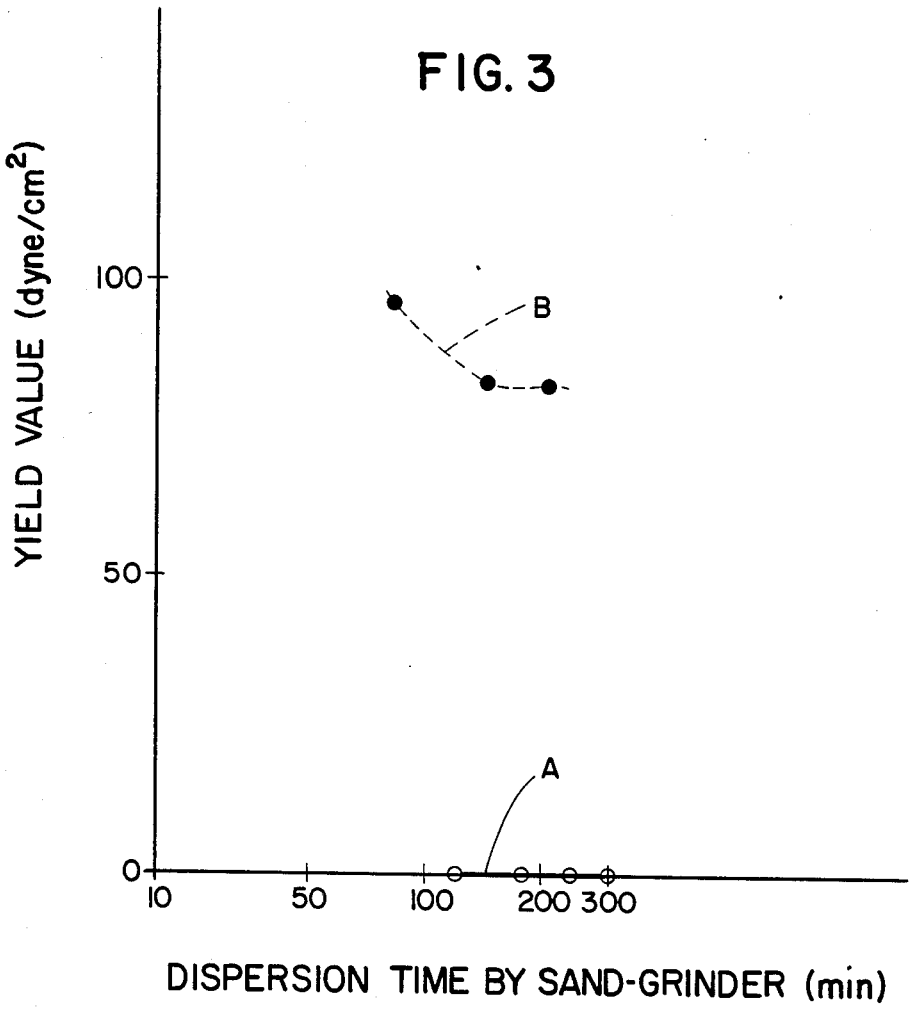
FIGS. 3 and 4 are graphs showing the effects of the invention.

Residual viscosity and yield values of each dispersed paste, i.e. both the treated and non-treated pastes, were measured with an E-type viscometer (by Tokyo Keiki). The results are reported in Table 2. The yield values are also shown in FIG. 3 in which the abscissa is the dispersion time in minutes based on a logarithmic scale and the ordinate is the yield value in [dyne/cm$^2$] on a regular scale. A sand grinder was used to disperse the surface treated and non-treated pigments into pastes.

The activated pigments were dispersed into a paste labeled "A" and the non-treated pigments were dispersed into a paste labeled "B". The change in temperature and the change in power consumption of the sand-grinder were measured as each pigment was dispersed into its paste. These measurements are presented in Table 3.

After applying each dispersed paste with a doctor blade onto a glass plate to a thickness of about 4 mil, the change in 60° specular gloss was measured for each paint film throughout the dispersion process. The results are presented in Table 4.

Figure 4:
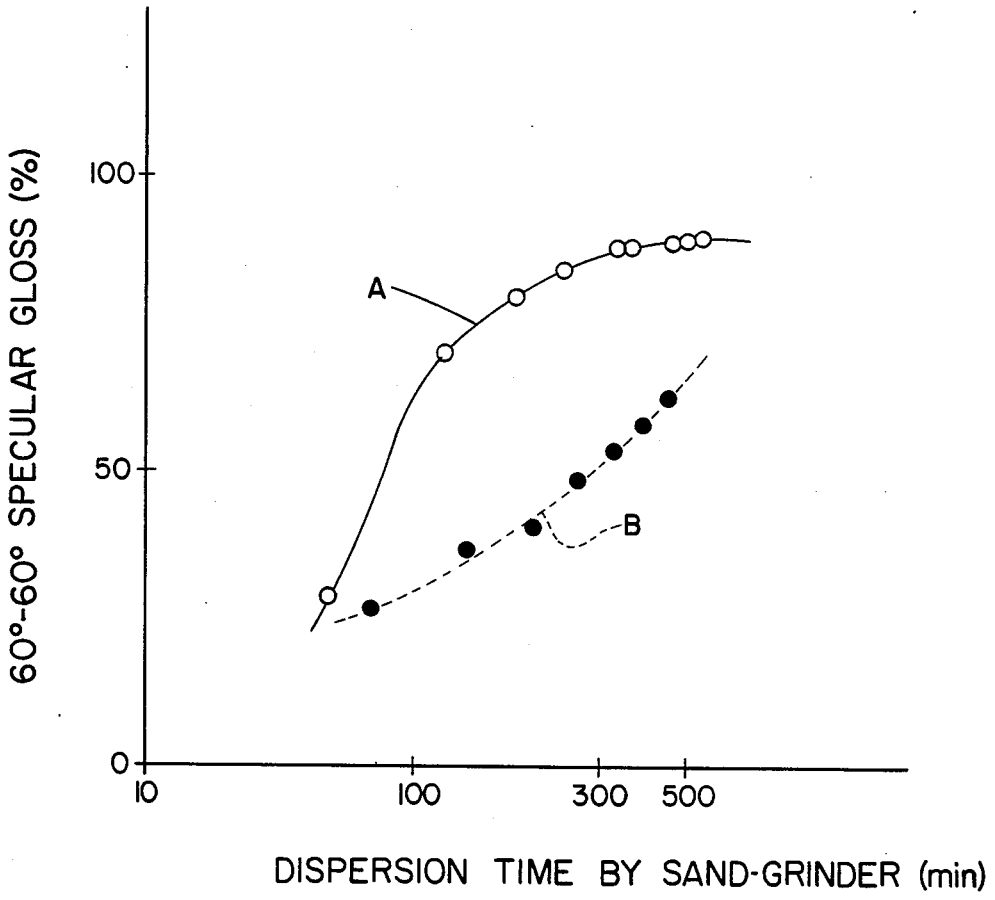

These results are also presented in graphical form in FIG. 4 in which the abscissa shows dispersion time in minutes by the sand-grinder on a logarithmic scale and the ordinate shows 60°—60° gloss [%] on a regular scale.

The activated (treated) pigments were dispersed into a paste labeled "A" and the non-treated pigments were dispersed into a paste labeled "B". The pastes obtained were dissolved respectively into varnish (Alkyd varnish R-5532 made by Nippon Paint containing amphoteric alkyd resin of the short oil type of 54% non-volatile content and about 2000 molecular weight) to make paint. Paint films were then formed from these paints by using a doctor blade, and tristimulus values of their colors were measured on a spectrophotometer. These results are presented in Table 5. Paint films were also formed by spray coating and baking and the tristimulus values, and corresponding computed L, a, b (values of the R. S. Hunter color difference equation), of the paint films that were measured on a spectrophotometer are also set forth in Table 5.

In this regard, calculation of the L, a, b values from measured tristimulus values used the cube root equation system as set forth by R. S. Hunter in *The Journal of The Optical Society of America*, Volume 38, 611, 1094 (1948). The basic equations of the system are:

$$L = 10\sqrt{Y}$$

$$a = \frac{17.5\,(1.02\,X - Y)}{\sqrt{Y}}$$

$$b = \frac{7.0\,(Y - 0.847Z)}{\sqrt{Y}}$$

This system offers a degree of simplicity that is lacking in most other color order systems. Color differences existing between a treated batch and a standard non-treated batch can be expressed as follows:

$$\Delta L = L(\text{treated}) - L(\text{non-treated})$$
$$\Delta a = a(\text{treated}) - a(\text{non-treated})$$
$$\Delta b = b(\text{treated}) - b(\text{non-treated})$$
$$\Delta E = \sqrt{(\Delta L)^2 + (\Delta a)^2 + (\Delta b)^2}$$

Positive values of ΔL indicate the treated is lighter than the non-treated, negative values indicate the treated is darker than the non-treated. Positive Δa values indicate the treated is redder (less green) than the non-treated, negative Δa indicates the treated is greener (less red) than the non-treated. Similarly, positive Δb values indicate the treated is yellower (less blue) than the non-treated, negative Δb indicates the treated is bluer (less yellow) than the non-standard. ΔE is the total color difference.

The measurement of the tristimulus values and L, a, b values of these paint films are used to evaluate the effect of the activating treatment on the hue of the quinacridone pigment.

TABLE 2

| | | Residual viscosity [cP] | | Yield value [dyne/cm$^2$] | |
|---|---|---|---|---|---|
| | | Treated | Non-Treated | Treated | Non-Treated |
| Dispersion time by sand-grinder [min] | 80 | — | 79 | — | 97 |
| | 120 | 71 | — | 0 | — |
| | 140 | — | 87 | — | 83 |
| | 180 | 88 | — | 0 | — |
| | 200 | — | 67 | — | 83 |
| | 240 | 90 | — | 0 | — |
| | 300 | 87 | — | 0 | — |

TABLE 3

| | | Power consumption of sandgrinder [W] | | Temperature of Paste [°C.] | |
|---|---|---|---|---|---|
| | | Treated | Non-Treated | Treated | Non-Treated |
| Dispersion time by sand-grinder [min] | 60 | 123 | 125 | 28 | 30 |
| | 120 | 144 | — | 29 | — |
| | 130 | — | 131 | — | 30 |
| | 180 | 144 | 122 | 29 | 31 |
| | 240 | 121 | 127 | 30 | 31 |
| | 300 | 152 | — | 30 | 31 |
| | 360 | 111 | 157 | 30 | 31 |
| | 420 | 120 | 167 | 30 | — |
| | 480 | — | — | 29 | — |

TABLE 3-continued

| | Power consumption of sandgrinder [W] | | Temperature of Paste [°C.] | |
|---|---|---|---|---|
| | Treated | Non-Treated | Treated | Non-Treated |
| 510 | 158 | — | — | — |

TABLE 4

| | | 60° specular gloss [%] | |
|---|---|---|---|
| | | Treated | Non-Treated |
| Dispersion time of sand-grinder [min] | 60 | 29 | — |
| | 80 | — | 27 |
| | 120 | 70 | — |
| | 140 | — | 38 |
| | 180 | 79 | — |
| | 200 | — | 42 |
| | 240 | 85 | — |
| | 260 | — | 49 |
| | 320 | — | 54 |
| | 330 | 88 | — |
| | 360 | 88 | — |
| | 380 | — | 59 |
| | 440 | — | 63 |
| | 460 | 89 | — |
| | 510 | 89 | — |
| | 540 | 89 | — |

TABLE 5

| | Treated | | | Non-Treated | | |
|---|---|---|---|---|---|---|
| Tristimulus value of paint films formed using a doctor blade. | (X) 10.1 | (Y) 5.1 | (Z) 1.1 | (X) 12.5 | (Y) 6.2 | (Z) 1.4 |
| L, a, b of paint films formed by spray-coating and baking. | (L) 22.6 | (a) 40.4 | (b) 13.0 | (L) 24.9 | (a) 46.2 | (b) 14.0 |

As shown in Table 2 and FIG. 3, when powder (pigment) is subjected to surface treatment with a gas which is at least a partly reactive gas and is then dispersed in varnish to make a paste, this treated paste has a yield value of zero. A yield value of zero indicates Newtonian flow and favorable fluidity. When non-treated pigment is dispersed in varnish to make a paste, the yield value is very high, which indicates poor fluidity.

As shown in Table 3, there is no increase in power consumption of the sand grinder during dispersion even when dispersing time is extended for the treated pigment. In contrast there is an increase in power consumption when the dispersing time is extended for the non-treated pigment. Temperature remains almost constant during dispersion for the treated pigment while temperature tends to increase for the non-treated pigment. This is probably related to the poor fluidity of the non-treated pigment.

As shown in Table 4 and FIG. 4, the treated pigment shows a better 60° specular gloss than that of the non-treated pigment and in the treated paste it is improved within a shorter dispersion time. This indicates that the activating treatment improves both the dispersion of the pigment and the fluidity of the paste.

The values shown in Table 5 were obtained under conditions that closely approached the conditions under which the paints would normally be applied and viewed. As the table indicates, the spray coated film of treated pigment is darker and more blue but less red in color than the spray coated film of untreated pigment, confirming the equation mentioned above. L, a and b are approximately the same for the treated paint films and the non-treated paint films, although a difference can be noticed. This difference may not cause by any problem in actual application as the resulting paints may be used with other paints. These results clearly demonstrate that the dispersion stability of powder can be improved by the present invention without unfavorably affecting other properties of the powder.

The crude pigments of phthalocyanine blue and phthalocyanine green as powders were subjected to surface treatment (activating treatment) under the same conditions set forth above. These crude pigments precipitate and separate within a short time when suspended in water without applying any treatment. When they are subject to the above stated activating treatment for 30 minutes and then suspended in water, however, their suspension is stable even 24 hours later. In other words, dispersion stability of the pigments improves.

When small balls of polystyrene (beads of 10 to 20 $\mu$m diameter) are subjected to surface treatment under the same conditions as stated above, the same results were obtained.

The reactive gas generator used for these examples is very small and reactive gas generating efficiency is not high. By using a larger generator, however, reactive gas can be generated more efficiently and surface treatment of powder can be finished within a shorter time.

Figure 2:
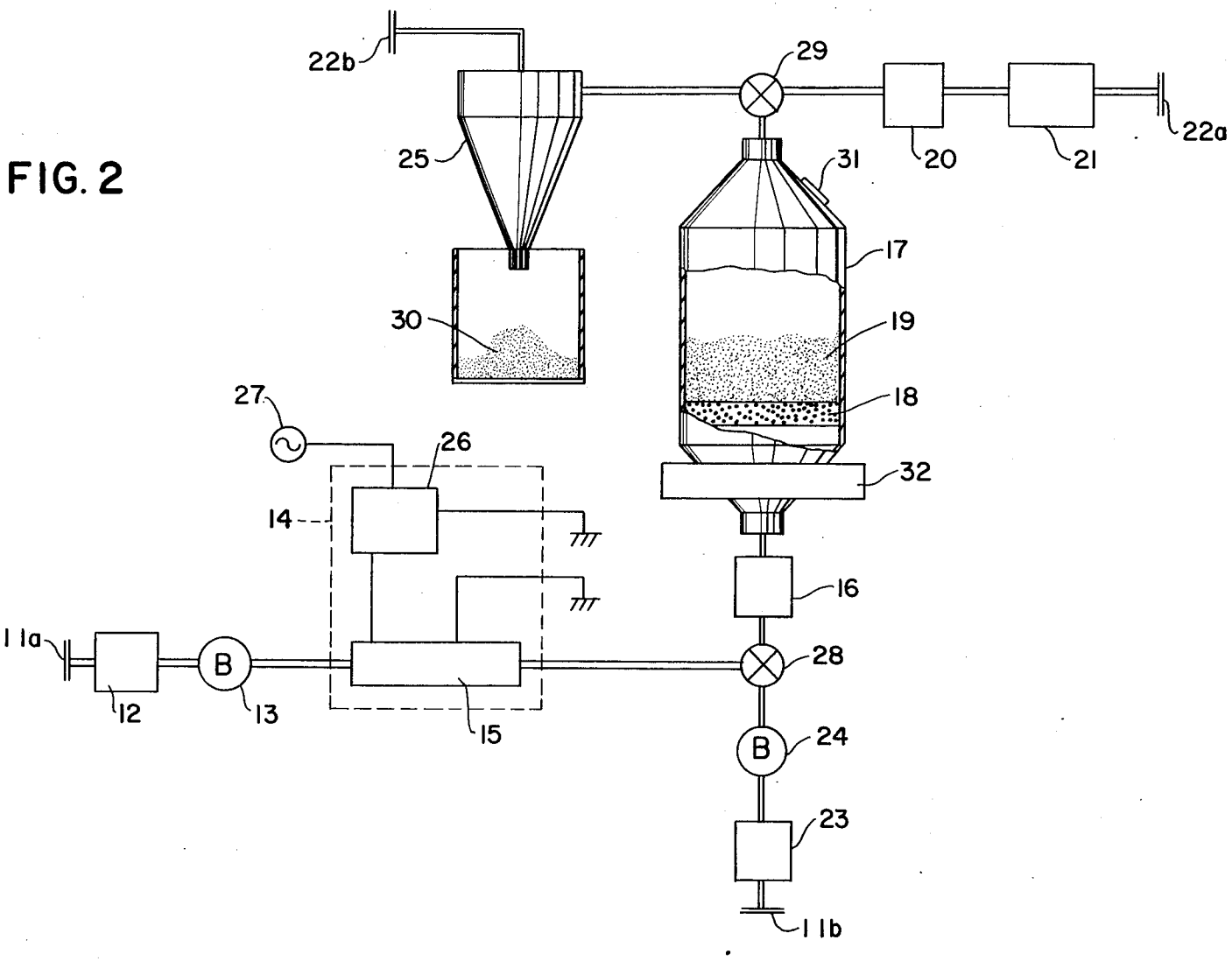
FIG. 2 is a drawing of apparatus suitable for industrial application of the invention.

The apparatus described below for reference is preferred for industrial application of the invention. As shown in FIG. 2, gas such as air is drawn through an inlet 11*a*, filtered and dried by a filter and dryer 12, then is conducted to the reactive gas generating tube 15 of the reactive gas generator 14 by the blower 13. In the reactive gas generating tube 15, the air is converted into air containing reactive gas using, for example, apparatus as shown in FIG. 5, and is then blown up into the lower part of the fluidized bed reactor 17 though filter 16 and porous plate 18 to form a fluidized layer of powder 19 for surface treatment.

The air containing the reactive gas is filtered through the filter 20, and ozone is absorbed into ozone killer 21, and then the air is discharged through outlet 22*a*.

Afterwards, air from inlet 11*b* is filtered by filter 23, blown upwards by recovery blower 24, and then the powder is sent in a floating, suspended condition to recovery cyclone 25.

The powder is recovered by cyclone 25 and the air is discharged through outlet 22*b*. 26 is a high-frequency oscillator, 27 is a power source for the reactive gas generator, 28, 29 are valves controlling air flow, 30 is treated powder and 31 is the powder feed inlet. 32 is a vibrator to vibrate the fluidized bed as required. By this vibration, the pores of the porous plate are prevented from clogging up for better stirring of the fluidized layer.

In the above embodiment, the present invention is explained by an example of dispersion improvement of pigments. The powder surface treating method of the present invention, however, is not limited to the examples cited therein but is also effective for surface treatment of powders for different purposes as long as the treatment involves using reactive gas.

By the powder surface treating method of the present invention, powder is converted into a fluidized layer by blowing gas, which consists at least partly of reactive gas, for surface treatment. Accordingly, surface treatment of the powder can be made fully, evenly and uniformly. The method produces excellent results from such treatment, such as, improved dispersion of powder in fluid and improved properties of the product.

The apparatus for providing a fluidized layer has a porous plate with small holes, smaller than the powder particles, and means to generate reactive gas and means to supply gas which is made at least partly of reactive gas and generated using said reactive gas generating means, into said fluidized bed through said porous plate. The powder surface treating apparatus of the present invention enables easy practice of the powder surface treating method.

A gas that does not contain oxygen, for example pure nitrogen, can also be activated and used as the reactive gas according to the method and apparatus set forth above.

However, gases which do not contain oxygen, for example industrial grade nitrogen, normally provide lower performance in producing functional groups such as carboxyl, carbonyl, hydroxyl and nitro groups. These gases which do not contain oxygen can also produce other functional groups, such as amino groups, resulting in different performance when the treated powder is dispersed in the carrier or vehicle, as compared to the performance and results obtained with an oxygen containing gas.

I claim:

1. Apparatus for surface treating powder to improve dispersion thereof in a polar fluid by creating polar groups on the powder surface by blowing a gas including a reactive agent through the powder to produce polar groups, on the powder surface, having affinity for polar fluids, comprising:

a. enclosed reactor means including a porous plate therewithin for supporting said powder, said pores of said plate being smaller than particles of said powder, b. means for blowing gas upwardly through said porous plate and through powder on said plate to fluidize said powder above said plate, and c. means for producing reactive agent in said gas prior to gas passage through said plate and said powder resting thereon, said means having two kinds of electrodes in contact with a source of a high frequency high voltage signal is applied.

2. An apparatus for powder surface treatment in accordance with claim 1 in which said means for producing a reactive agent in said gas is a high-frequency surface discharge ceramic electrostatic device.

3. Apparatus for powder surface treatment as defined by claim 1, wherein said gas blowing means blows the gas through the porous plate as air at 1 to 5 m/min. passing speed and 0.1 to 2 mol % of ozone content to maintain powder density in the fluidized bed at 0.5 to 20 $g/cm^2$.

4. Apparatus for powder surface treatment as defined by claim 1, wherein the gas passed through the porous plate is incombustible gas of 1 to 5 m/min. passing speed and 0.1 to 2 mol % ozone content, and powder density in the fluidized bed is 0.5 to 20 $g/cm^2$.

5. Apparatus for powder surface treatment as set forth in claim 1, further comprising means for vibrating the fluidized powder layer.

6. Apparatus for surface treating synthetic pigment powder of the quinacridone series, to increase dispersion stability thereof in a polar varnish fluid for paint by producing polar carboxyl groups and/or carbonyl groups by blowing gas generated by a high-frequency surface discharge type reactive gas generator through the powder, comprising:

a. enclosed reactor means including a porous plate therewithin for supporting said powder, said pores of said plate being smaller than particles of said powder, b. means for blowing gas upwardly through said porous plate and through powder on said plate to fluidize said powder above said plate, said gas blowing means blowing the gas through the porous plate as air at 1 to 5 m/min. passing speed and 0.1 to 2 mol % of ozone content to maintain powder density in the fluidized bed at 0.5 to 20 $g/cm^2$, c. a high frequency surface discharge ceramic electrostatic device for producing reactive agent in said gas prior to gas passage through said plate and said powder resting thereon, and d. means for vibrating the fluidized powder layer.

* * * * *